US005394712A

United States Patent [19]

Chou

[11] Patent Number: 5,394,712

[45] Date of Patent: Mar. 7, 1995

[54] MOTORCYCLE LOCK

[75] Inventor: Patrick Chou, Taipei, Taiwan, Prov. of China

[73] Assignee: Nigostar Industry Co., Ltd., Taipei, Taiwan, Prov. of China

[21] Appl. No.: 179,703

[22] Filed: Jan. 11, 1994

[51] Int. Cl.[6] ..... E05B 67/22

[52] U.S. Cl. ..... 70/38 A; 70/226; 70/416

[58] Field of Search ..... 70/38 A, 38 B, 38 C, 70/ 38 R, 39, 52–56, 416, 417, 225, 226

[56] References Cited

U.S. PATENT DOCUMENTS

| | | | |
|---|---|---|---|
| 1,721,747 | 7/1929 | Radosevic | 70/38 A |
| 3,395,555 | 8/1968 | Hickman | 70/38 C |
| 3,979,931 | 9/1976 | Man | 70/52 X |
| 4,290,280 | 9/1981 | Yun | 70/52 X |
| 4,409,805 | 10/1983 | Wang | 70/32 |
| 4,584,855 | 4/1986 | Burlingame | 70/38 A |
| 4,881,387 | 11/1989 | Kortenbrede | 70/39 |
| 5,189,893 | 3/1993 | Kortenbrede | 70/38 A |
| 5,195,340 | 3/1993 | Huang | 70/238 X |

FOREIGN PATENT DOCUMENTS

| | | | |
|---|---|---|---|
| 2141170 | 12/1984 | United Kingdom | 70/38 A |

*Primary Examiner*—Peter M. Cuomo
*Assistant Examiner*—Suzanne L. Dino
*Attorney, Agent, or Firm*—Morton J. Rosenberg; David I. Klein

[57] ABSTRACT

A motorcycle lock is provided which includes a lock body consisting of a metal casing and a lock unit fitted into the metal casing. The lock unit includes two locking plates at the top and a lock cylinder at the bottom, and a shackle having two annular grooves around two opposite ends thereof and respectively inserted into a respective hole on the metal casing and locked by the locking plates. Turning the lock cylinder in one direction causes the locking plates to move in the reverse directions for permitting the shackle to be removed from the lock body. Turning the lock cylinder in the reverse direction causes the stop blocks of the left and right locking plates to engage the annular groove on opposing ends of the shackle for holding down the shackle.

2 Claims, 7 Drawing Sheets

11
1
11
441
442
445'
443
444'
444
445
44
441'
432
443'
431
421
442'
44'
43
421'
432'
431'
31
42
43'
4
41
32
31
42'
3
411

PRIOR ART

PRIOR ART

MOTORCYCLE LOCK

BACKGROUND OF THE INVENTION

The present invention relates to a motorcycle lock which uses two locking plates to hold down each end of the shackle at two opposite sides.

Various motorcycle locks have been disclosed, and have appeared on the market. These motorcycle locks are generally comprised of a long shackle and a lock body having holes to receive the two opposite ends of the long shackle and a locking mechanism to lock the long shackle in position. the locking mechanism is controlled by the key to move a steel ball 51 (see FIGS. 7 and 7A) or lock bolt 62 (see FIGS. 8 and 8A) causing it to engage into a groove 52 or 61 on either end of the long shackle. Because the steel ball 51 or lock bolt 62 simply engages into the groove 52 or 61 on either end of the long shackle at one side, the locking is unstable and less strong, and therefore the motorcycle lock may be unlocked easily by a pry bar.

SUMMARY OF THE INVENTION

The present invention has been accomplished to provide a motorcycle lock which eliminates the aforesaid disadvantage.

According to the preferred embodiment of the present invention, the motorcycle lock comprises a lock body consisting of a metal casing and a lock unit fitted into the metal casing, the lock unit including two locking plates at the top and a lock cylinder at the bottom, and a shackle having two annular grooves around two opposite ends thereof and respectively inserted into a respective hole on the metal casing and locked by the locking plates, the locking plates having symmetrical stop blocks, and wherein turning the lock cylinder in one direction causes the locking plates to move in reverse directions for permitting the shackle to be removed from the lock body; turning the lock cylinder in the reverse direction causes the stop blocks of the left and right locking plates to engage into the annular groove on opposing ends of the shackle for holding down the shackle. Because each end of the shackle is locked in position by two stop blocks on opposing sides thereof, the locking is ensured.

DETAILED DESCRIPTION OF THE PREFERRED EMBODIMENTS

Figure 1:
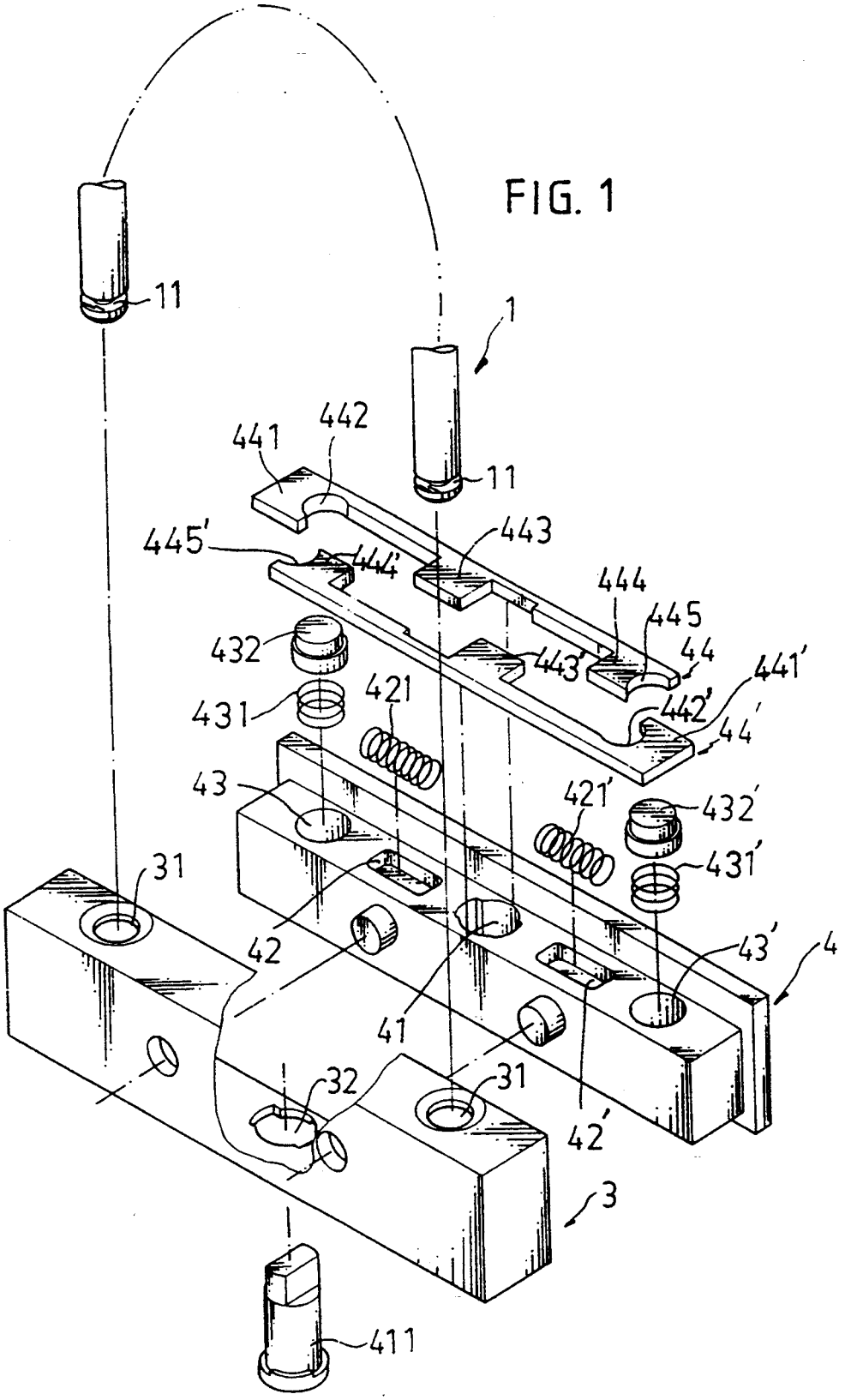
FIG. 1 is an exploded view of a motorcycle lock according to the preferred embodiment of the present invention.

Referring to FIGS. 1, 2, 3, and 4, a motorcycle lock in accordance with one embodiment of the present invention is shown, generally comprised of a shackle 1 and a lock body 2. The shackle 1 is made of a substantially U-shaped rod having two annular grooves 11, 11' formed in each of the opposing ends thereof for locking. The lock body 2 comprises a casing 3 and a lock unit 4. The lock unit 4 fits into the casing 3'. The lock unit 4 includes circular center through hole 41 vertically formed in the middle thereof. A lock cylinder 411 is inserted into the circular center through hole 41'. Two circular recesses 43, 43' are formed vertically at the two opposite ends of the lock unit, in parallel with the circular center through hole 41'. Each recess 43, 43' receives a respective spring element 431, 431' and a respective cap 432, 432'.

Two rectangular recesses 42, 42' are horizontally disposed between the circular center through hole 41 and the respective circular recesses 43, 43'. The two symmetrical locking plates, namely, the left locking plate 44 and the right locking plate 44' are symmetrically disposed at the top of the lock unit 4. Each locking plate 44, 44' comprises a first stop block 441, 441' at one end having an arched notch 442, 442' formed therein, the notch fitting over one side of the cap 432, 432'. A second stop block 444, 444' at an opposite end has an arched notch 445, 445' disposed in the same direction relative to the arched notch 442, 442' on the first stop block 441, 441' and fitting over the cap 432, 432'. Each lock plate 44, 44' includes a transmission block 443, 443' in the middle thereof, disposed on a respective side of cylinder 411.

The casing 3 comprises two circular top holes 31, 31' respectively aligned with the circular recessed holes 43, 43' on the top of the lock unit 4, and a circular bottom hole 32 aligned with the circular center through hole 41 on the bottom of the lock unit 4. The two opposing ends of the shackle 1 are inserted into the respective circular top holes 31, 31' of the casing 3 and stopped against a respective cap 432, 432'.

Figure 2:
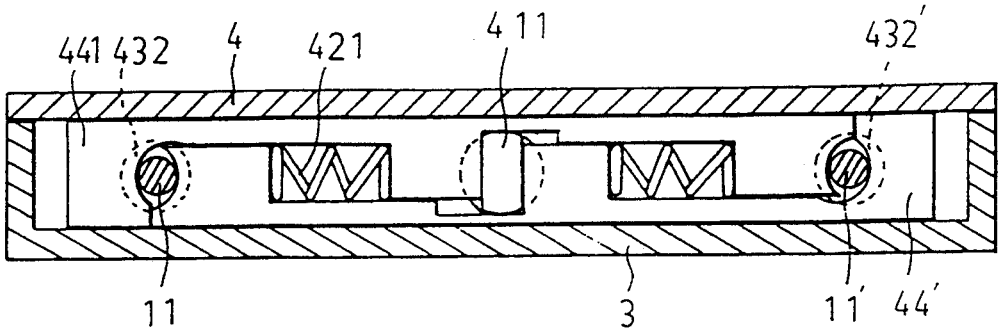
FIG. 2 is a cross-section of the motorcycle lock of FIG. 1 taken in the horizontal direction when unlocked.

As shown in FIG. 2, when the lock cylinder 411 is turned by the key from the locking position to the unlocking position, the locking plates 44, 44' are moved in opposing directions, causing the compression springs 421, 421' to be compressed, and therefore release the shackle 1 from the lock body 2.

Figure 3:
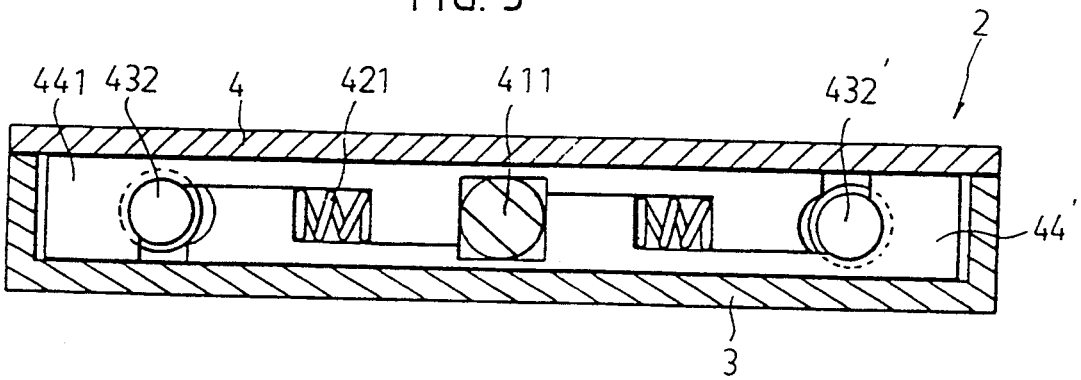
FIG. 3 is similar to FIG. 2 but showing the lock locked.
Figure 4:
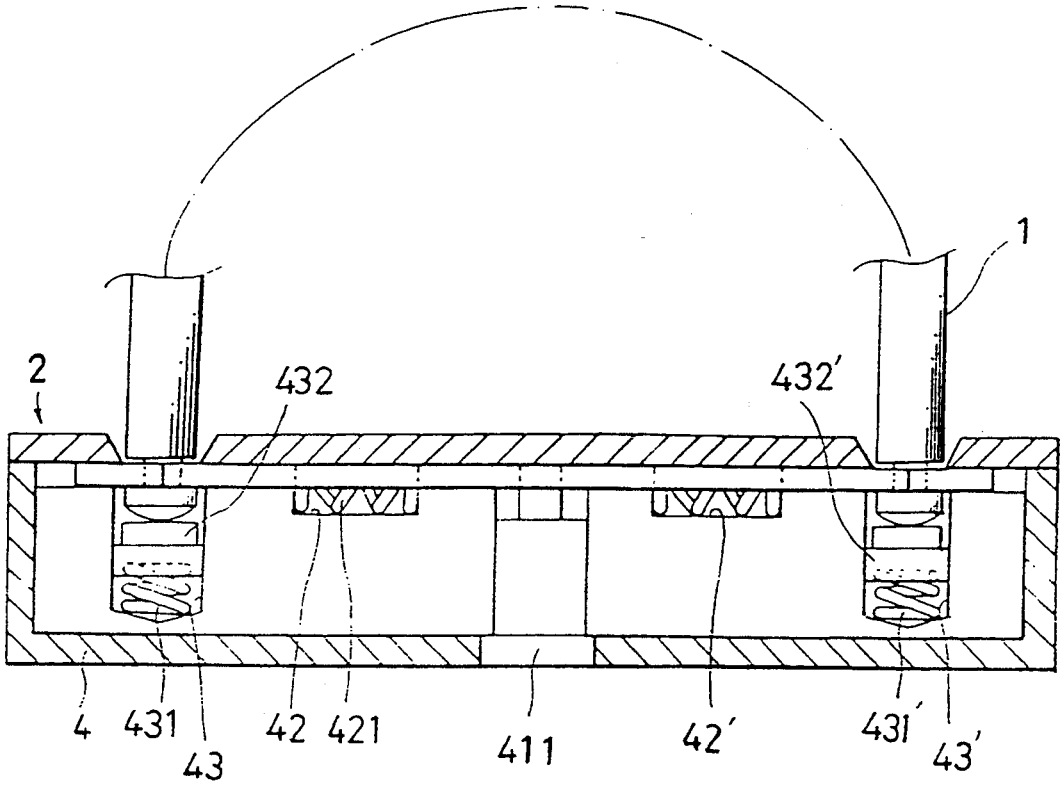
FIG. 4 a cross-section of the motorcycle lock of FIG. 1 taken in the vertical direction when locked.

As shown in FIGS. 3 and 4, when the two opposite ends of the shackle 1 are respectively inserted into the circular top holes 31, 31' on the casing 3 and pressed against the caps 432, 432' to compress the respective spring element 432, 431', the arched notches 442, 445'; 442', 445 become forced by the spring elements 421, 421' to engage the annular groove 11 on respective ends of the shackle 1, causing the shackle 1 to be locked by the locking plates 44, 44'.

Figure 5:
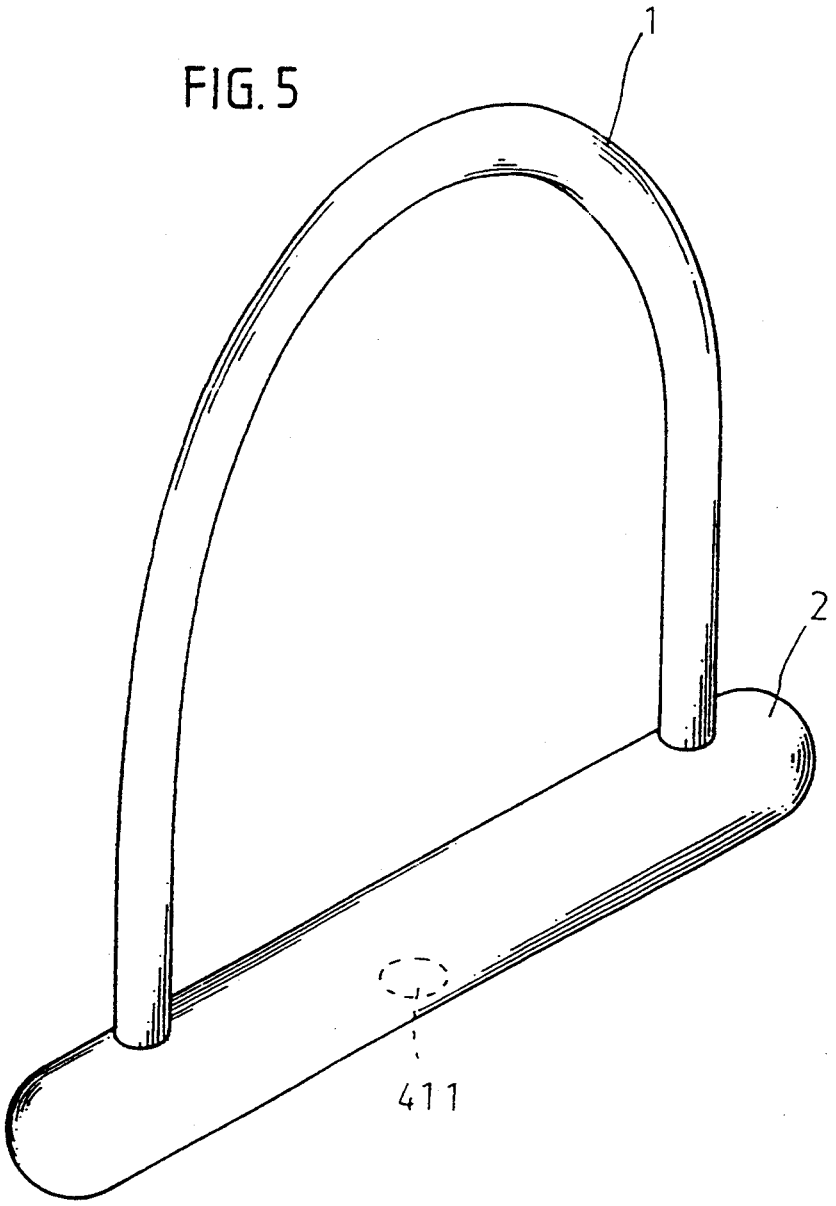
FIG. 5 shows the outer appearance of an alternate form of the present invention.

Referring to FIG. 5, the lock body 2 may be made in a cylindrical shape, having two smoothly curved opposing ends. It is recommended that the lock body 2 be formed of metal and covered with a plastic covering.

Figure 6:
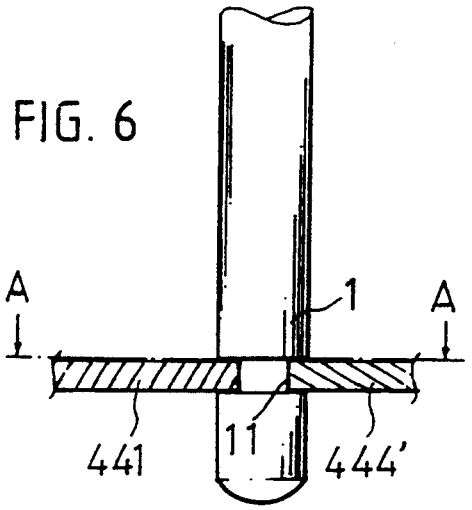
FIG. 6 shows one end of the shackle of the motorcycle lock of the present invention locked by a steel ball.
Figure 6A:
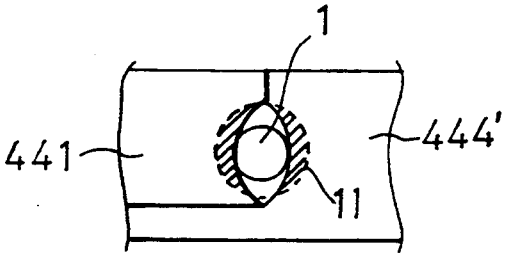
FIG. 6A is a sectional view taken along line A—A of FIG. 6.
Figure 7:
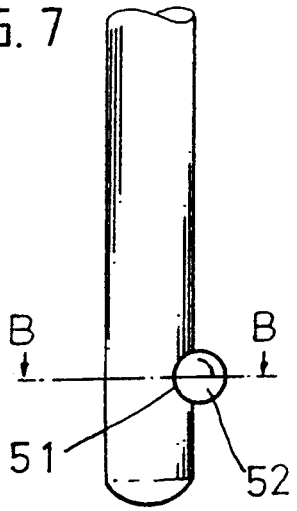
FIG. 7 shows one end of the shackle of a prior art motorcycle lock locked by a steel ball.
Figure 7A:
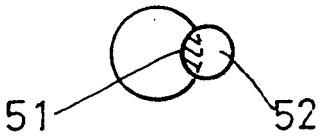
PRIOR ART FIG.7A
FIG. 7A is a sectional view taken along line B—B of FIG. 7.
Figure 8:
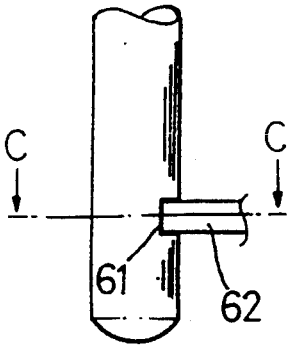
FIG. 8 shows one end of the shackle of another prior art motorcycle lock locked by a lock bolt; and, FIG. 8A is a sectional view taken along line C—C of FIG. 8.
Figure 8A:
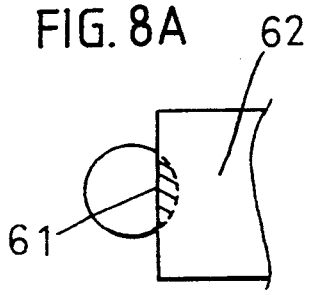
PRIOR ART FIG. 8A

Referring to FIGS. 6 and 6A, there is shown one end of the shackle i locked between the first stop block 441 of the left locking plate 44 and the second stop block 444' of the right locking plate 44'. The shadowed area in FIG. 6A shows the overlapped area between the annular groove 11 and the first and second stop blocks 441,444'.

While only one embodiment of the present invention has been shown and described, it will be understood that various modifications and changes could be made without departing from the spirit and scope of the invention.

I claim:

1. A motorcycle lock, comprising:

a longitudinally extended housing having a pair of longitudinally spaced first through openings formed in an upper wall thereof and a second through opening formed in a lower wall of said housing, said second through opening being disposed in a central portion of said lower housing wall;

a substantially U-shaped shackle having a pair of opposing ends respectively insertable into said pair of first through openings, each of said pair of opposing ends having an annular groove formed therein;

a longitudinally extended lock body disposed within said housing, said lock body having a pair of longitudinally spaced circular recesses formed in an upper surface thereof, each of said pair of circular recesses being positionally located for correspondence with a respective one of said pair of first openings of said housing, said lock body having a through bore formed in a central portion thereof and extending from a lower surface thereof to said upper surface, said through bore being located in correspondence with said second through opening of said housing, said lock body having a pair of rectangularly shaped recesses formed in said upper surface, each of said pair of rectangular recesses being disposed between said through bore and a respective one of said pair of circular recesses;

a pair of first spring members, each of said pair of first spring members being disposed in a respective one of said circular recesses and extending transverse said longitudinal direction, each of said first spring members having a first end in contact with a respective bottom surface of said circular recess;

a pair of cap members, each of said pair of cap members being disposed in a respective one of said circular recesses and having one end thereof in contact with a second end of a respective one of said first spring members;

a pair of second spring members, each of said second spring members having a longitudinally extended portion thereof disposed in a respective one of said pair of rectangular recesses;

a pair of locking plates disposed on said upper surface of said lock body, each of said pair of locking plates having a pair of corresponding arched notches formed on opposing first and second laterally extended ends thereof, each of said pair of locking plates having a camming tab portion extending laterally therefrom, said pair of locking plates being disposed in side by side relationship with (1) said first laterally extended end of one of said locking plates being adjacent said second laterally extended end of said other of said locking plates with an open end of one of said arched notches facing an open end of another of said arched notches, and (2) said camming tab portions of said locking plates being respectively positioned on opposing longitudinal sides of said through bore of said lock body, each of said second spring members being disposed between a camming tab portion of a respective one of said locking plates and said second laterally extended end of said other of said locking plates for applying a bias force therebetween; and, a lock cylinder rotatively mounted in said through bore of said lock body and having a pair of opposing camming surfaces on one end thereof, each of said opposing camming surfaces being in contact with a respective one of said locking plate camming tab portions for displacing said locking plates in opposing directions responsive to rotation of said lock cylinder, each of said annular grooves of said opposing ends of said shackle being engaged by a respective facing pair of said arched notches responsive to displacement of said locking plates against said bias of said pair of second spring members by rotation of said lock cylinder in a first direction and disengaged by rotation in a second opposing direction.

2. The motorcycle lock of claim 1 wherein said lock body is formed in a cylindrical contour having a pair of opposing rounded ends.

* * * * *